United States Patent [19]

Saunders

[11] 3,964,413

[45] June 22, 1976

[54] METHODS FOR NECKING-IN SHEET METAL CAN BODIES

[75] Inventor: William T. Saunders, Weirton, W. Va.

[73] Assignee: National Steel Corporation, Pittsburgh, Pa.

[22] Filed: July 22, 1974

[21] Appl. No.: 490,281

[52] U.S. Cl. ..... 113/120 AA; 72/370; 113/120 R

[51] Int. Cl.[2] ..... B21D 51/00

[58] Field of Search..... 113/120 R, 120 AA, 120 S, 113/120 H; 72/370, 354

[56] References Cited

UNITED STATES PATENTS

| | | | |
|---|---|---|---|
| 718,379 | 1/1903 | Painter | 113/119 |
| 865,257 | 9/1907 | Kohl | 113/120 R |
| 3,581,542 | 6/1971 | Wahler | 72/94 |
| 3,687,098 | 8/1972 | Maytag | 113/120 R |
| 3,763,807 | 10/1973 | Hilgenbrink | 113/120 R |

*Primary Examiner*—Victor A. DiPalma
*Attorney, Agent, or Firm*—Shanley, O'Neil and Baker

[57] ABSTRACT

Die-forming method for forming necked-in flanging metal on a light gauge drawn and ironed can body with a longitudinally extended transition zone between the necked-in portion and the original can body diameter portion while avoiding wrinkling or puckering of the flanging metal. In an initial stage of the die-forming operation, sheet metal contiguous to the peripheral edge is strengthened by turning such edge inwardly about a small radius. The strengthening member formed exerts a lateral restraint during a second stage of the die-forming operation in which the flanging metal and longitudinally extended transition zone are formed. The die-forming operation is carried out from a single end of the can body using a loose fitting inner die which is readily removable from the working end after reducing the diameter of such end.

5 Claims, 10 Drawing Figures

Figure 10:
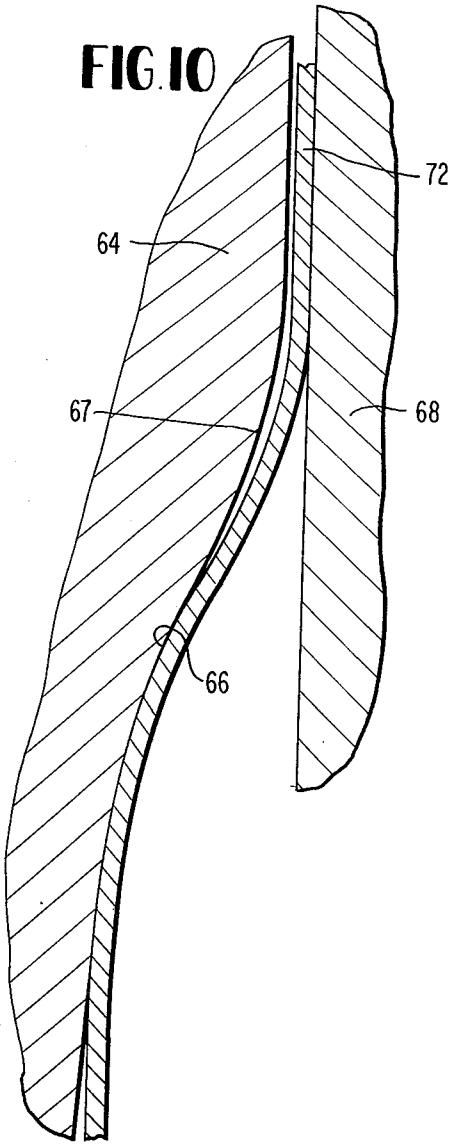

FIG. 1
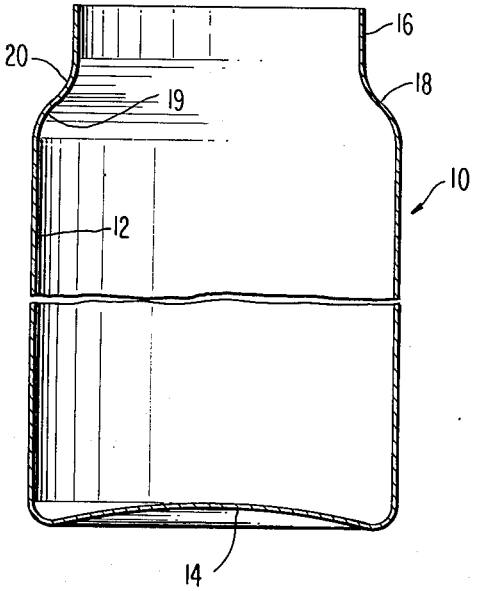
FIG. 2
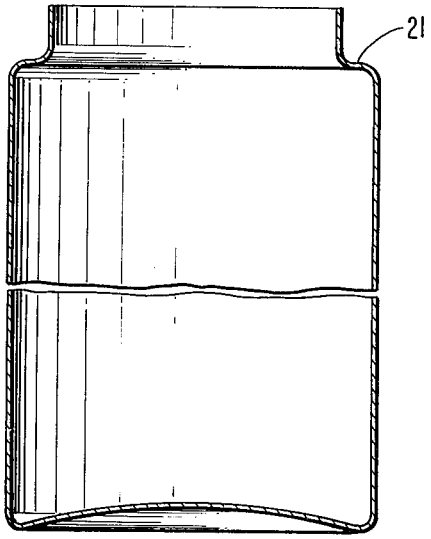
FIG. 3
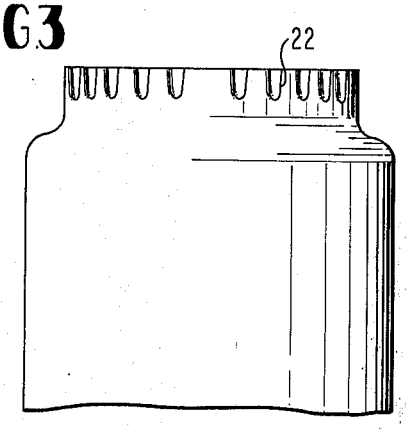
FIG. 4
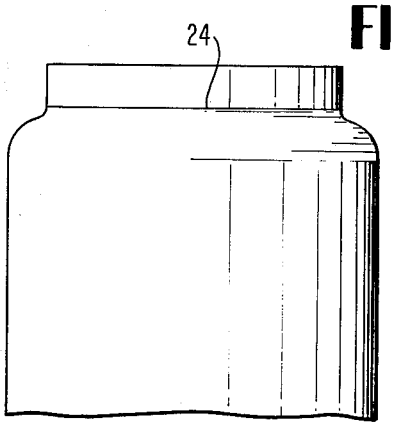
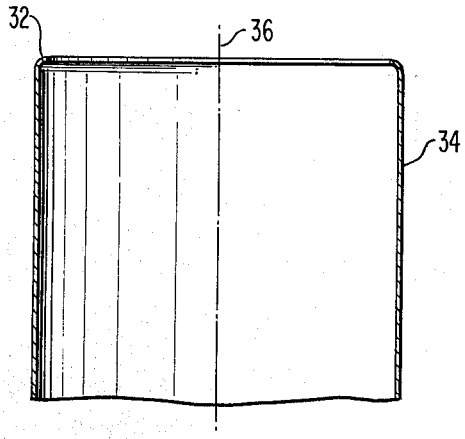
FIG. 5
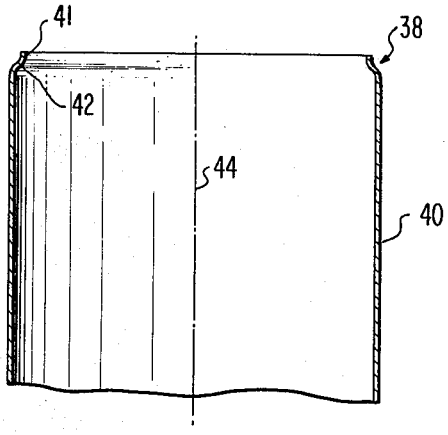
FIG. 6

METHODS FOR NECKING-IN SHEET METAL CAN BODIES

This invention relates to necking-in of a sheet metal can body sidewall and, more particularly, to a novel multi-step die-forming necking-in operation.

It is known to neck-in portions of can bodies to form flanging metal of reduced diameter at a longitudinal end of a can body. As discussed in U.S. Pat. Nos. 3,680,350 and 3,687,098, a protuding double seam causes handling, stacking and packaging problems which are eliminated by the necked-in accomodation for a chime seam. Another advantage, pointed out in U.S. Pat. No. 3,688,538, is that necking-in permits the use of smaller end closures which are more economical and stronger than the conventional end closures.

While there are reasons for preferring a die-forming type necking-in operation, the wrinkling or "puckering" of metal during a suitable reduction in diameter is a major disadvantage. Such metal wrinkling is unsightly, causes uneven capping tool wear, and has a tendency to crack during flanging or seaming. One approach to avoid this metal wrinkling problem involves a spinning operation to form the necked-in portion (See, e.g., U.S. Pat. Nos. 3,763,807 and 3,765,351). Such spinning operations add complexity and cost.

Other prior art approaches include (U.S. Pat. No. 3,670,921) use of stress relief notches to help prevent wrinkling of the metal and to prevent cracking of the metal during flanging. Or, as described in U.S. Pat. No. 3,687,098, a special mechanism for moving both the punch and punch plate members, and consequently the container, in the same direction during the necking-in operation to reduce friction.

The invention teaches a multi-stage die-forming operation performed from one open end of a can body without need for acess from the remaining longitudinal end of the can body. While the invention is applicable to both side seamed and seamless can bodies, difficulties associated with necking-in of a seamless can body, having a sidewall and a unitary end wall, are more pronounced since the operation must be carried out from a single open end. These difficulties are accentuated with drawn and ironed steel container bodies which, due to the ironing operation, are usually in a full-hard condition in the area to be worked.

The present invention enables die forming to produce the desired depth and desired diameter neck with the flanging metal thus formed being free of wrinkling, with a smooth uninterrupted surface along the neck and between the neck and the original diameter of the can body sidewall, and with a curvilinear transition zone between the neck and original diameter providing sufficient strength for applying an end closure without collapse at such curvilinear portion.

Further background, problems encountered in this development, solutions, and benefits of the present invention are described in more detail using the accompanying drawings. Individual figures of these drawings are briefly identified as:

FIG. 1 is a sectional view of a seamless can body necked-in in accordance with the present invention, free of wrinkles and free of any transition lines contiguous to the reduction in diameter.

Figure 9:
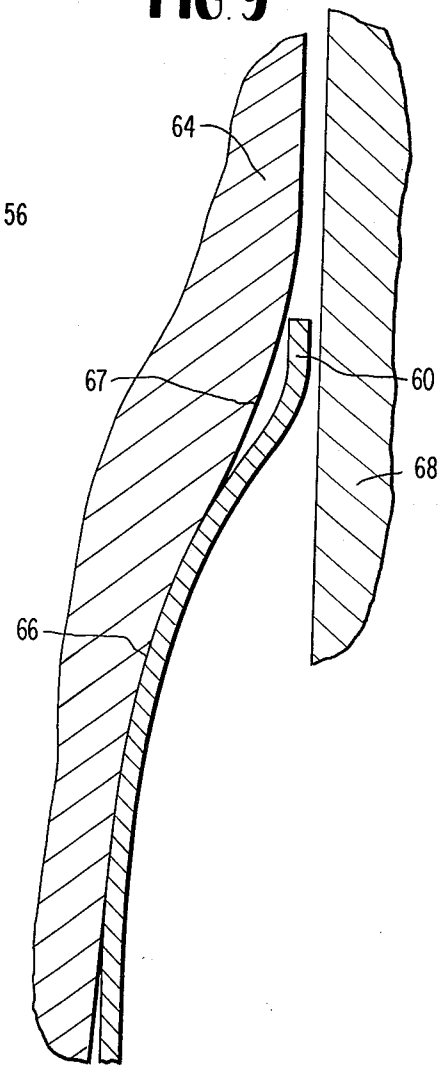
Figure 8:
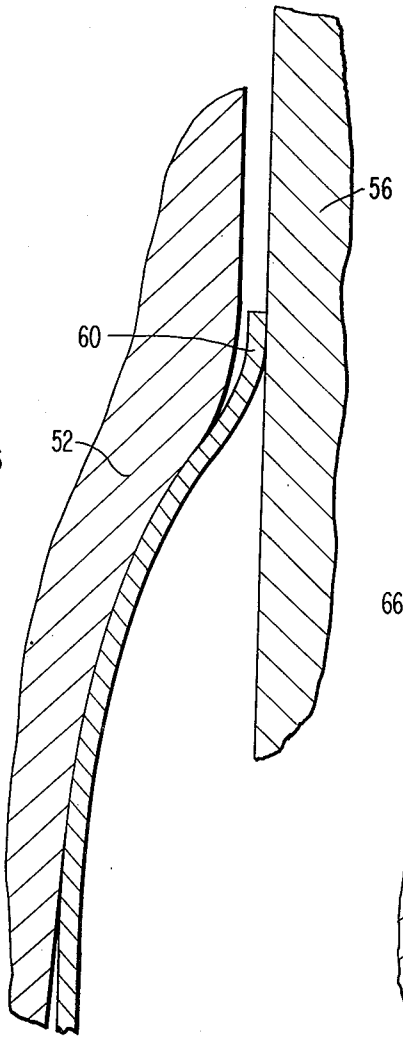
Figure 7:
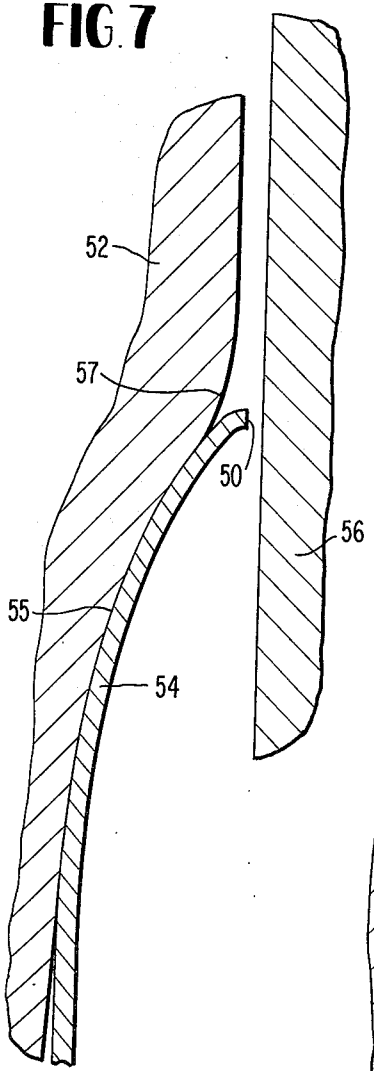

FIG. 2 is a sectional view of an undesirable type of shallow-depth curvilinear juncture between the necked-in diameter and the diameter of the main can body, FIG. 3 is a partial sectional view showing the undesirable wrinkles or "puckering" of the flanging metal which are eliminated by the present invention, FIG. 4 is a partial sectional view showing an undesirable transition line of the type eliminated by the present invention, FIG. 5 is a partial sectional view showing a small-radius of curvature formed during a portion of the initial stage of the present invention, FIG. 6 is a partial sectional view showing a short-height, small-radius of curvature strengthening hoop formed during the initial stage of the present invention, FIG. 7 is an enlarged partial sectional view of a portion of die members and a portion of a sheet metal can body sidewall during a portion of the initial die-forming stage of the present invention, FIG. 8 is an enlarged partial sectional view of a portion of die members and a portion of a sheet metal can body sidewall during completion of formation of a strengthening hoop in accordance with the present invention, FIG. 9 is an enlarged partial sectional view showing a portion of the die members and a portion of a sheet metal can body sidewall with strengthening means during the ram approach of a later stage of the die-forming operation in accordance with the present invention, and FIG. 10 is an enlarged partial sectional view showing a portion of the die members and a portion of a sheet metal can body sidewall during completion of the die-forming of the extended length necked-in configuration of the can body of FIG. 1.

The seamless can body 10 of FIG. 1 includes sidewall 12 and unitary bottom wall 14. The necked-in portion at the open end of can body 10 has the desired configuration; i.e. an extended length necked-in (reduced diameter) portion 16 and a relatively large (longitudinally extended) curvilinear-configuration transition zone 18 joining the necked-in diameter portion 16 to the main can body diameter of sidewall 12. The transition zone curves inwardly about a radius of curvature 19 and curves upwardly about an oppositely disposed radius of curvature 20. In a typical twelve-ounce beverage can having an overall height of approximately 5¼ inches, the longitudinal length of the necked-in flanging metal 16 is generally required to be at least 0.25 inch for double seaming an end closure to the can body. The necked-in flanging metal can extend to 0.75 inch, or more, to accommodate a conventional plow-type can opener as described in U.S. Pat. No. 3,608,774.

The curvilinear configuration transition zone 18 should be extended longitudinally rather than being of shallow depth. Other aspects which facilitate the necking-in operation conflict with can wall strength requirements for applying an end closure. Divergent requirements present inherent difficulties in trying to satisfy both operations, i.e., necking-in and later applying an end closure. These problems are especially accentuated with thin gage beverage type cans. This gage drawn and ironed beverage cans can have a metal thickness gage as low as .003 inch at the neck portion although .005 inch gage is more typical.

Viewed from the aspect of the necking-in operation, it has been found that a short shallow, transition zone between the neck and main body would be helpful in avoiding wrinkling or puckering of the sheet metal contiguous to the transition zone. However, a shallow curvilinear transition zone 21 (FIG. 2) providing sufficient reduction in diameter is likely to collapse under the forces encountered in applying an end closure. Therefore a transition zone which is longitudinally extended is desirable from the point of view of preventing collapse when applying an end closure. However, it has been found that flanging metal and/or metal in the necked-in portion will invariably wrinkle or "pucker" when attempting, in a single step, to die-form the desired length neck with a longitudinally extended transition zone between the two diameter portions.

FIG. 3 shows the type of wrinkes 22 which form in the flanging metal when attempting to form a longitudinally deep necked-in portion with a longitudinally extended transition zone in a single die-forming step. Such wrinkling can extend into the transition zone. It has been found that these wrinkles are not eliminated by merely dividing the necking-in operation into two major steps without following the teachings of the present invention.

It has also been found that if necking-in is merely divided into large die-forming steps, an unsightly stress line will apear across the necked-in portion, generally at the upper end of the transition zone, in a plane perpendicular to the longitudinal axis of the can body. FIG. 4 shows the type of transition line 24 which occurs as a result of the first necking-in operation when dividing the necking-in operation into major steps. This transition line, in addition to unsightliness, denotes an area of stress likely to break during flanging or seaming operations.

Also, it is desirable to perform the necking-in operation without substantially changing the height of the can. A can body sidewall has a uniform height as received; with a seamless can body the peripheral edge at the open end of the can body is spaced longitudinally a uniform distance from the bottom wall juncture with the sidewall. The necked-in portion, of the seamless or seamed sidewall, should be formed without a substantial change in this uniform height. Since the necked-in portion has a smaller diameter than the diameter of the main can body the excess metal generated would lengthen the can body. This excess metal should be absorbed in the horizontal (transverse to the longitudinal axis) portion of the transition zone. To a limited extent, the metal at the open end of the container may also be thickened to compensate for the reduction in diameter. Therefore a carefully controlled and uniform displacement of the metal at the open end of the container is required in order to avoid formation of wrinkles or puckering in the metal and in order to avoid showing a transition line. These objectives are achieved by the present invention.

Another accomplishment of the invention is performing the necking-in operation with access from only one end of the can body. No inside support member continually exerting die-forming force is required. Any interior die member used must be loose fitting to permit it to be readily removed after a reduction in diameter at the open peripheral edge of a can body sidewall. In effect the inner die acts as a guide or "pilot" die. Notwithstanding working with drawn and ironed material, which is in a full-hard condition, the present invention works from only one end of the can body and with only the outer die exerting a die-forming force for any substantial length of time during the necking-in operation.

The inventive concept which overcomes the difficulties encountered with necking-in thin gage can bodies involves using a portion of the sheet metal can body itself for control of metal movement; in effect as a unitary strengthening member to prevent uneven metal collapse during the reduction in circumference of the necking-in operation. The unique multi-stage operation of the present invention involves, initially, a novel strengthening step. In this step the peripheral edge of the can body, and/or contiguous sheet metal, is formed to act as a strengthening member. This causes the excess metal generated during necking-in to be displaced in a controlled and uniform fashion about the full circumference without wrinkling.

Working at the open end of a sheet metal sidewall of substantially uniform-diameter cylindrical configuration, a strengthening member is die-formed in the peripheral edge metal of an open end of the can body. The peripheral edge metal is turned about a small radius of curvature inwardly toward the central axis. This small radius of curvature is substantially less than the final neck-in radius of curvature and forms peripheral edge metal into a strengthening rim-like member of substantially larger circumference than the final neck-in circumference. This strengthening member exerts a lateral, radially uniform restraint about the periphery so as to hold the desired, smooth, circular configuration of the can body edge and prevent wrinkling or puckering of the metal during a subsequent more drastic reduction in diameter which generates excess metal to be moved. Also, because of this initial strengthening step, the necking-in is carried out smoothly without marring or interruption of the necked-in surface; i.e. without a transition line.

Such a strengthening rim-like member is shown during formation in FIGS. 5 and 6. Initial curvature 32 of FIG. 5 is formed about a small radius of curvature at the open-end peripheral edge of the can body sidewall 33. This radius of curvature is measured in cross section as viewed at the top edge of FIG. 5. Representative of a small radius of curvature as used would be a radius of approximately 0.05 inches for a twelve-ounce beverage container. Ordinarily this radius would be about ten times the thickness of the metal but no greater than about fifteen times the thickness of the metal.

The peripheral edge is turned inwardly toward longitudinal central axis 36 about such small radius of curvature 32. Then, as part of the same die-forming step, i.e., using the same tooling, a short-height, small radius strengthening hoop 38 is die-formed at the peripheral edge of the sidewall 40. Typically, with a twelve-ounce steel beverage container in which the sheet metal has been drawn and ironed to have a sidewall gage of less than about 0.005 inch contiguous to the edge, the strengthening hoop 38 would include a longitudinally extending portion 41 with a longitudinal dimension of less than 0.0625 inch.

The lateral reinforcement or strengthening provided is sufficient to uniformly distribute forces in the metal at the can body edge to enable such metal to move uniformly inwardly and upwardly during the reduction in diameter during formation of a full-sized neck as shown in FIG. 1. That is, adequate strength is provided for a subsequent longitudinally deep necking-in operation without metal wrinkling.

The upright portion 41 of strengthening hoop 38 is formed by a slight turning of the peripheral edge upwardly toward the open end of the can body in a direction parallel to the central axis 44. In forming a strengthening hoop, the small radius of curvature outer die is merely worked slightly further in a longitudinal direction until the peripheral edge of the side-wall contacts the loose-fitting pilot-type die described. Contacting the inner die turns the peripheral edge initially upwardly and then back on itself so that the metal moves without gripping the inner die. This permits the inner die to be removed easily from the open end.

The steps in forming the strengthening hoop, and the final neck are shown in sequence in FIGS. 7 through 10. Edge 50 is initially turned inwardly as shown in FIG. 7. Outer die 52 turns the sidewall sheet metal 54 through a small radius of curvature 55 toward inner pilot die 56. The outer die has essentially a single radius of curvature 55 turning inwardly; the die surface then turns abruptly upwardly at 57.

Outer die member 52 continues movement longitudinally toward the opposite end of the sidewall as shown in FIG. 8. The peripheral edge of the sheet metal which has been turned inwardly will contact the inner die 56 and turn upwardly as illustrated forming strengthening hoop 60.

The necking-in sequence as shown in FIGS. 9 and 10 is carried out with another die of desired dimensions. The outer die 64 of FIGS. 9 and 10 has a radius of curvature 66 which is directed inwardly and, then, an oppositely disposed large radius of curvature 67 so as to form a curvilinear transition zone of desired depth and strength for applying an end closure.

Cylindrical configuration interior die 68 has a diameter allowing at least for the thickness of the metal and clearance. Sufficient clearance is essential to prevent friction of the metal being worked during its relative movement, upwardly between the outer and inner dies. Representative clearances may be 20 percent to 25 percent of the theoretical metal thickness; for example, the space between the dies may be between one and about two times the metal thickness. This provides for ease of removal of the tools after the necking-in operation.

FIG. 9 shows the position of the strengthening hoop 60 at the start of the stroke. Outer die 64, at radius of curvature 66, contacts that sheet metal at a location spaced downwardly longitudinally from the previously formed strengthening member 60. Movement of outer die 64 downwardly causes relative movement of the sheet metal, contiguous to the peripheral edge, upwardly between the outer and inner dies to form the flanging metal necked-in portion 72 of FIG. 10. This flanging metal between the dies moves upwardly without substantial working of the metal by the loose-fitting inner die 68. The strengthening member formed initially restrains the metal laterally and enables it to move smoothly upwardly as a transition zone of large radius is formed.

The radii of curvature for the outer die used for forming the final neck can be as much as thirty to fifty times the thickness of the sheet metal when working with drawn and ironed steel. Typically, these radii are always greater than fifteen times the thickness of the sheet metal stock being worked.

The formation of the strengthening member utilizes a reduction in diameter which is a fraction of the reduction for the neck finally formed. This initial reduction in diameter would ordinarily be about 50 percent to 60 percent of the total reduction in diameter, but can extend to as high as 75 percent to 90 percent of the total reduction on certain can sizes while maintaining the relatively small radius of curvature described.

Clearances for both stages permits the inner die to be removed readily from the open end of the container. The radius of curvature of the working surface of the outer die for the initial strengthening step and the radii for the final necking-in step can vary depending on the size of the can and the gauge of the sheet metal. For commonly used beverage cans, such as 10 ounce, 12 ounce and slightly larger steel cans, an outer die for the initial strengthening step would have a radius of curvature between about 0.05 and .06 inches; with larger diameter cans, such as the four and a quarter inch fruit juice can, this radius would be proportionately larger but still a "small" radius in the sense discussed. The necking die surface would have radii between about 0.1875 inch and 0.25 inch for such commonly used beverage cans. The necking-in radius would be greater than 15 times the metal thickness.

The length of the strenthening hoop measured parallel to the central axis could vary up to about 0.0625 inch maximum for typical gauges of food and beverage container stock.

Typical gauges for sheet metal contiguous to the peripheral edge after drawing and ironing are about 0.005 to 0.0075 inch for flat rolled steel and about 0.0065 to about 0.0085 inch for flat rolled aluminum. Other than the multi-stage necking-in operation described, the technology for the formation of drawn or drawn and ironed cups, and the operating machinery, are conventional and well known, so that detailed descriptions would not aid in an understanding of the present invention.

The necked-in portion can be extended longitudinally as desired utilizing the teachings of the present invention; typically flanging metal between about ⅛ inch and about ¾ inch in height would be provided.

Principles of the invention disclosed are applicable to larger or smaller sized food and beverage cans in the light of the above teachings so that the scope of the invention is not to be limited by the specific dimensions and details set forth, but is to be determined from the appended claims.

I claim:

1. In the manufacture of a sheet metal container, a multi-stage die-forming method for necking-in the open end of a can body to provide flanging metal free of wrinkles, comprising the steps of providing an open-ended can body having a sidewall of substantially cylindrical configuration about a longitudinally extended central axis, the sidewall defining an open end having a peripheral edge, die-forming a strengthening member in the sheet metal contiguous to the open-end with a first set of dies including an outer strengthening-member die cooperating with an inner pilot die by turning such peripheral edge inwardly with such outer strengthening-member die toward the central axis of the can body about a radius of curvature of a dimension in the range of about ten to fifteen times the thickness of the sheet metal being die formed, the peripheral edge being turned inwardly about the full circumference of such peripheral edge and then turning such peripheral edge with the inner pilot die toward such open end to extend in a direction parallel to the central axis, such extension of sheet metal in the direction parallel to the central axis having a longitudinal dimension of less than .0625 inch, and then die-forming such open end with strengthening member to form a reduced diameter neck with a second set of dies including an outer necking-in die and an inner pilot-type die by contacting the can body sidewall at a location adjacent to but spaced longitudinally from the strengthening member with the outer necking-in die to form a curvilinear configuration transition zone between the original can body and the reduced diameter neck and to form wrinkle-free flanging metal, such transition zone being formed about a radius of curvature which is greater than fifteen times the thickness gage of the sheet metal being die formed, such necked-in flanging metal having a longitudinal dimension which is a plurality of times greater than the corresponding longitudinal dimension of the initially formed strengthening member.

2. The method of claim 1 in which the sheet metal comprises flat rolled steel having a thickness gauge between about 0.003 inch and 0.0075 inch at a location contiguous to such peripheral edge.

3. The method of claim 1 in which the sheet metal comprises flat rolled aluminum having a thickness gauge contiguous to such peripheral edge between about 0.0065 inch and 0.0085 inch.

4. The method of claim 1 in which the longitudinal dimension parallel to the central axis of the necked-in flanging metal is between about 0.125 inch and about 0.75 inch.

5. The method of claim 1 in which the inner pilot die of the first set of dies and the inner pilot-type die of the second set of dies are cylindricallyshaped with clearance, in addition to the thickness of the sheet metal being worked, between portions of such respective die sets which are parallel to the central axis being between about 20 percent and about 100 percent of the thickness of the sheet metal being worked.

* * * * *

UNITED STATES PATENT OFFICE

CERTIFICATE OF CORRECTION

PATENT NO. : 3,964,413

DATED : June 22, 1976

INVENTOR(S) : William T. Saunders

It is certified that error appears in the above-identified patent and that said Letters Patent are hereby corrected as shown below:

Column 2, line 62, "This" should read --Thin--.

Column 3, line 40, "the" second occurrence should read --a --.

Column 4, line 42, "inches" should be --inch--;

line 55, after "longitudinally" insert -- - --;

line 64, after "longitudinally" insert -- - --.

Column 8, lines 14 and 15, "cylindricallyshaped" should read --cylindrically shaped--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*